US006844509B2

(12) United States Patent
Tsuchiya et al.

(10) Patent No.: US 6,844,509 B2
(45) Date of Patent: Jan. 18, 2005

(54) SWITCH DEVICE HAVING SELF-CLEANING FUNCTION

(75) Inventors: Junji Tsuchiya, Miyagi-ken (JP); Koji Dono, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/762,830

(22) Filed: Jan. 21, 2004

(65) Prior Publication Data

US 2004/0149561 A1 Aug. 5, 2004

(30) Foreign Application Priority Data

Feb. 3, 2003 (JP) ..... 2003-025972

(51) Int. Cl.[7] ..... H01H 9/00
(52) U.S. Cl. ..... 200/5 A; 200/457; 200/341
(58) Field of Search ..... 200/5 A, 5 R, 200/453, 457, 520, 341

(56) References Cited

U.S. PATENT DOCUMENTS 3,968,336 A * 7/1976 Johnson ..... 200/5 A
6,517,362 B2 2/2003 Hirai et al.

* cited by examiner

*Primary Examiner*—Kyung Lee
(74) *Attorney, Agent, or Firm*—Beyer, Weaver & Thomas LLP

(57) ABSTRACT

A switch device that prevents a contact failure from occurring between electrode contact points by having a self-cleaning function is provided. When a key top 4 is pushed downward, a portion between a winding start end 7*b* and a winding terminal end 7*c* of a spiral contactor 7 is extended by an operation part 3B provided in an actuator 3. At this time, the winding start end 7*c* slides along the surface of a stationary electrode 5. As a result, dusts or stains attached to the winding terminal end 7*c* and/or the stationary electrode 5, oxide films formed on the surfaces of the electrodes, etc., is self-cleaned. Therefore, it is possible to solve a contact failure problem between the movable electrode 6 and the stationary electrode 5.

4 Claims, 3 Drawing Sheets

SWITCH DEVICE HAVING SELF-CLEANING FUNCTION

BACKGROUND OF THE INVENTION

1. Field of the Invention

The present invention relates to a push button type switch device, and more particularly, to a switch device that prevents a contact failure from occurring at contact points.

2. Description of the Related Art

For example, Patent document 1 discloses a conventional push button type switch.

In the switch disclosed in Patent document 1, when a key top is pushed down, a dowel part provided below the key top uniformly pushes a driven element down and the entire surface of a movable contact point is brought in contact with a stationary contact point, thereby functioning as a switch.

Also, since the key top is returned to its original state by a resilient force of an arm when pressing against the key top is released, the key top is adapted to release the contact state between the movable contact point and the stationary contact point.

[Patent Document 1]

Japanese Utility Model Application Publication No. 7-31471

However, the conventional switch disclosed in Patent document 1 is configured such that the movable contact point is simply pressed down to contact the stationary contact point. As a result, when dusts or stains are adhered to the movable contact point or the stationary contact point, or when the movable contact point or the stationary contact point is oxidized, a contact failure may be caused between the movable contact point and the stationary contact point.

SUMMARY OF THE INVENTION

The present invention has been achieved in view of such drawbacks. It is therefore an object of the present invention to provide a switch device having a self-cleaning function, which prevents contact failure from being caused.

In order to achieve the above object, the present invention provides a switch device having a movable electrode, a counter electrode provided to face the movable electrode, and an operating member that pushes at least the movable electrode to bring the movable electrode into contact with the counter electrode. The movable electrode comprises an elastic deformation part that is extensibly deformed in a direction approaching the counter electrode and a sliding contact point that slides along the surface of the counter electrode when contacting the counter electrode.

In the present invention, when the operating member is pushed, the elastic deformation part of the movable electrode is pushed in and extended by the tip of the operating member. However, at the moment when the sliding contact point that is the tip (winding terminal end) of the elastic deformation part of the movable electrode comes in contact with the surface of the counter electrode, sliding friction is caused. Thus, it is possible to self-clean dusts or stains attached to the surface of the sliding contact point or the counter electrode or oxide films, etc. As a result, it is possible to prevent an electric contact failure from occurring between the movable electrode and the counter electrode.

Also, the counter electrode is formed as a movable electrode comprising the elastic deformation part and the sliding contact point.

In the above structure, since elastically deformed movable electrodes contact each other, the electrical contact between electrodes can be established more firmly.

More specifically, the movable electrode is formed as a spiral contactor spirally formed from its winding start end on the outer circumference side towards its winding terminal end on the center side, and the winding terminal end is formed as the sliding contact point.

In the above structure, since it is not necessary to add a return spring that pushes the operating member back, the number of parts can be reduced.

Also, a plurality of stages of electrodes having the elastic deformation part and the sliding contact point are stacked with a predetermined distance in the stacked direction at a position facing the movable electrode, and the movable electrode contacts respective counter electrodes that face the movable electrode in accordance with the push-in amount of the operating member in the stacked direction.

In the above structure, it is possible to construct a switch circuit having a plurality of switching functions.

BRIEF DESCRIPTION OF THE DRAWINGS

FIG. 1 is a sectional view of a switch device according to a first embodiment of the present invention wherein

DESCRIPTION OF THE PREFERRED EMBODIMENT

A switch device illustrated in each of the following embodiments represents, for example, one of a plurality of key switches arranged on a keyboard.

Figure 1A:
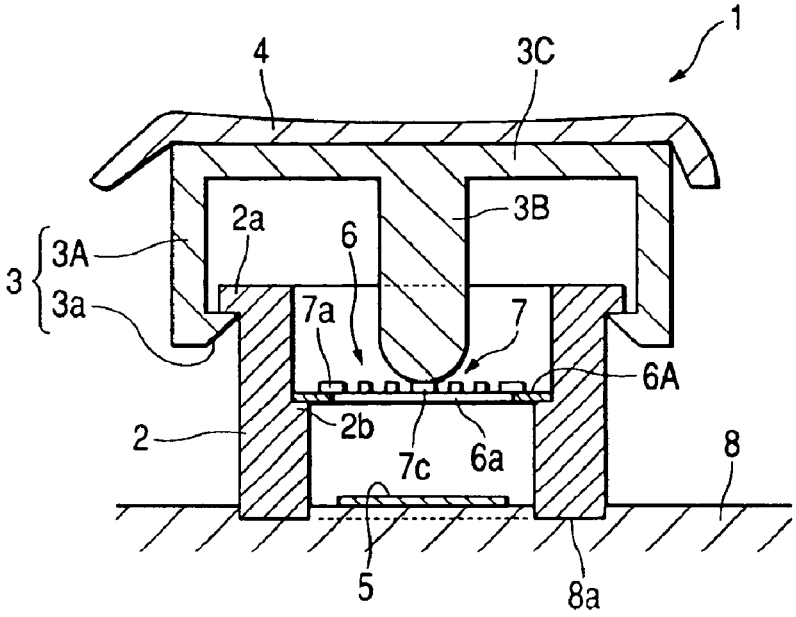
FIG. 1A illustrates a state of the switch device prior to operation.
Figure 1B:
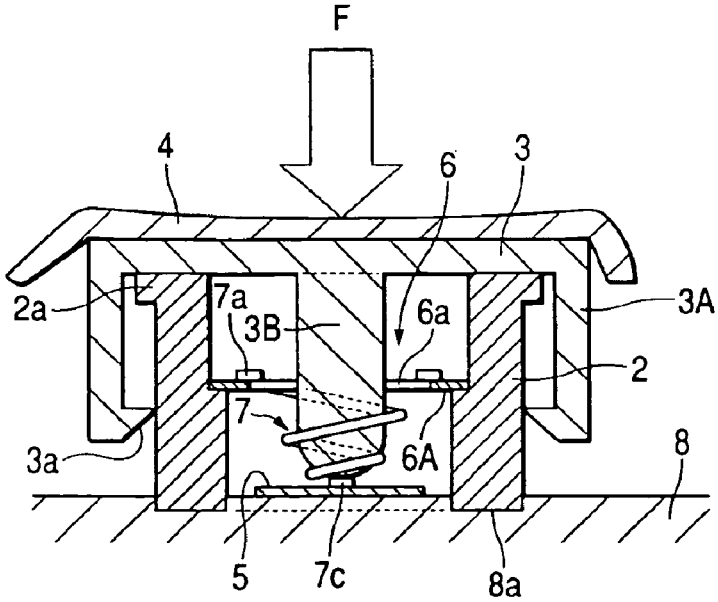
FIG. 1B illustrates a state of the switch device during operation.
Figure 2:
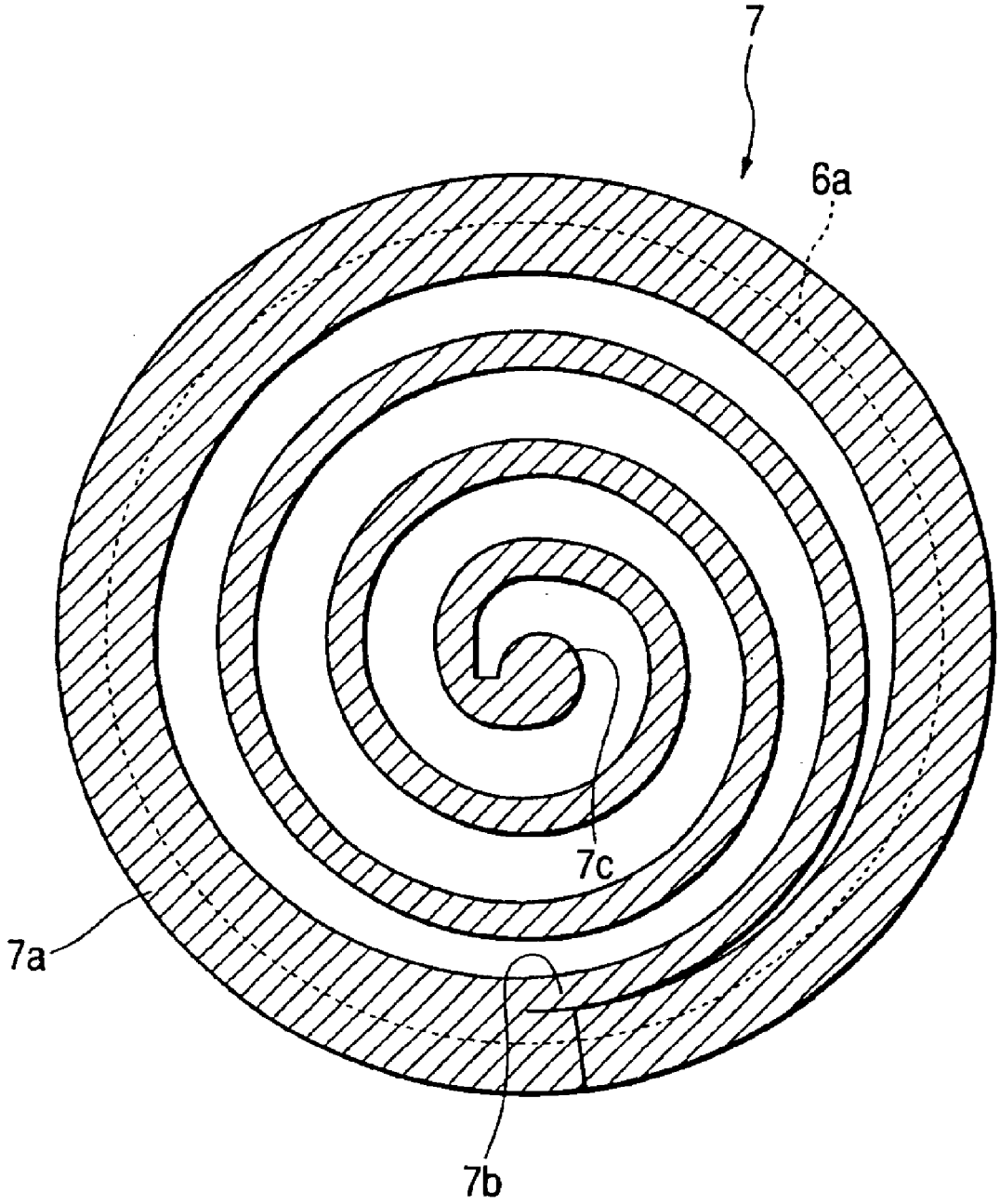
FIG. 2 is a plan view of a spiral contactor provided in a movable electrode.

FIG. 1 is a sectional view of a switch device according to a first embodiment of the present invention wherein FIG. 1A illustrates a state of the switch device prior to operation, FIG. 1B illustrates a state of the switch device during operation. FIG. 2 is a plan view illustrating a spiral contactor provided in a movable electrode.

As shown in FIGS. 1A and 1B, a switch device 1 according to the first embodiment of the present invention includes a key top 4 that has an actuator 3 on a case 2. The case 2 takes a cylindrical form. Also, a groove 8*a*, which corresponds to the shape of a lower opening end of the case 2, is formed in a board 8. The lower opening end of the case 2 is fixed to the groove 8*a*. An outer edge 2*a* that protrudes outwardly from the outer surface of the case 2 is provided around the upper opening end of the case 2. Also, a stepped part 2*b* is provided around the inside of the case 2 in a position to have a predetermined height dimension from the lower opening end of the case 2.

A stationary electrode 5 as a counter electrode is formed at the central portion of the groove 8*a* on the surface of the board 8. A movable electrode 6 that faces the stationary electrode 5 with a predetermined distance therefrom is formed in the stepped part 2*b* of the case 2.

The movable electrode 6 is formed on a board 6A provided with a through hole 6*a* at the center thereof. A spiral contactor 7 that is spirally formed of thin metal foil is provided inside the through hole 6*a* of the board 6A. As shown in FIGS. 1A and 2, the spiral contactor 7 is formed in the same plane, and is formed with an annular base 7*a* on the outer circumference side thereof. Thus, the outer circumference of the base 7*a* is fixed to the edge of the through hole 6*a*. Also, the spiral contactor 7 is provided with a winding start end 7*b* at the base 7*a* thereof, and a winding terminal end 7*c* of a tip that extends spirally from the winding start end 7*b* is disposed at the center of the through hole 6*a*.

Also, the stationary electrode 5 and the movable electrode 6 are connected to an external circuit. In particular, the lower stationary electrode 5 is integrally formed with an external connection pattern of the board 8.

The actuator 3 is formed in a substantially cylindrical shape that is one thickness larger than the case 2. A wall part 3A is provided in the outer circumference of a ceiling part 3C of the actuator and an operation part (operating member 3B) is formed to protrude from the inner center of the actuator. The wall part 3A, the operation part 3B, and the ceiling part 3C are integrally formed of non-conductive materials such as synthetic resin, and the wall part 3A and the operation part 3B extend downward from the ceiling part 3C. An inwardly protruding locking part 3*a* is provided around the lower opening end of the wall part 3A. Also, a tip of the operation part 3B is formed in a spherical shape.

Also, the key top 4 is fixed onto the top surface of the ceiling part 3C. Information such as letters, figures, or symbols is printed on the surface of the key top 4.

As shown in FIG. 1A, if the locking part 3*a* of the wall part 3A of the actuator 3 having the key top 4 is pushed downward in a state that is fitted to the upper opening end of the case 2, the locking part 3*a* of the actuator 3 ride over the outer edge 2*a* of the case 2 downward. Thus, the actuator 3 having the key top 4 is mounted on (snapped on) the case 2. In a state prior to this operation, the tip of the operation part 3B abuts the winding terminal end 7*c* of the spiral contactor 7.

As shown in FIG. 1B, when the key top 4 is pushed with pressing force F, the locking part 3*a* is guided by the external surface of the case 2 and the actuator 3 is moved downward. At this time, since the tip of the operation part 3B of the actuator 3 presses the winding terminal end 7*c* of the spiral contactor 7 downward, the spiral contactor 7 is extended. Also, the ceiling part 3C of the actuator 3 abuts the upper opening end of the case 2, and thus its downward movement as shown in the drawing is restricted. At the same time, the winding terminal end 7*c* of the spiral contactor 7 is brought in contact with the stationary electrode 5 by the operation part 3B. As a result, the movable electrode 6 is electrically connected to the stationary electrode 5.

Since the portion between the winding start end 7*b* and the winding terminal end 7*c* of the spiral contactor 7 is extended, at the moment when the winding terminal end 7*c* of the spiral contactor 7 contact the stationary electrode 5, the winding terminal end 7*c* slides along the surface of the stationary electrode 5. Thus, dusts or stains attached to the winding terminal end 7*c* and/or the stationary electrode 5 or oxide films formed on electrode surfaces (contact surfaces) can be self-cleaned. In this way, electrical contact failure between the movable electrode 6 and the stationary electrode 5 can be removed. In other words, the winding terminal end 7*c* of the spiral contactor 7 that constitutes the movable electrode 6 functions as a sliding contact point.

Also, when the pressing force F is released, the portion between the winding start end 7*b* and the winding terminal end 7*c* of the spiral contactor 7, which has been in its extended state, is contracted, and thus the operation part 3B moves upward. As a result, the actuator 3 having the key top 4 is returned to the state prior to operation as shown in FIG. 1A. In other words, the portion between the winding start end 7*b* and the winding terminal end 7*c* of the spiral contactor 7 constitutes a portion of the movable electrode 6 electrically connected to the stationary electrode 5. Also, the portion functions as an elastic deformation part that is extensibly deformed in the direction approaching the stationary electrode 5. Therefore, on the contrary to the conventional switch, it is not necessary to provide other members apart from an electrode, as a member (a dome part or return spring disclosed in Patent document 1) that returns the pushed key top to its original state. Therefore, it is possible to reduce the number of components.

Figure 3:
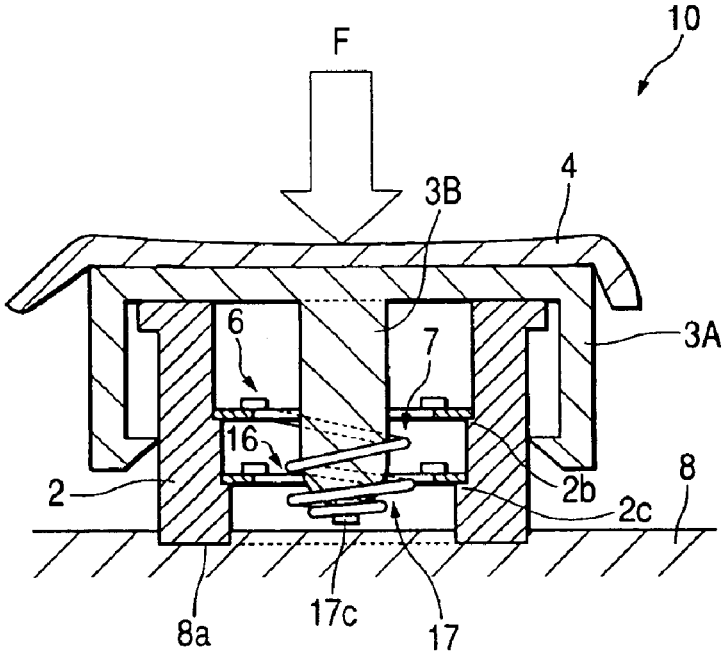
FIG. 3 is a sectional view illustrating a state of the switch device during operation, which is similar to that in FIG. 1B, according to a second embodiment of the present invention.

FIG. 3 is a sectional view illustrating a state of a switch device during operation, which is similar to that in FIG. 1B, according to a second embodiment of the present invention.

The structure of a switch device 10 according to a second embodiment of the present invention is different from that of the switch device 1 according to the first embodiment of the present invention in that a stepped part 2*c* is formed below the stepped part 2*b* inside the case 2, a second movable electrode 16 whose structure is the same as the movable electrode 6 is provided in the stepped part 2*c*, and the stationary electrode 5 as a counter electrode is not provided on the board 8. The other structure is the same.

In other words, in the second embodiment, the movable electrode 6 and the second movable electrode 16 provided as a counter electrode are stacked parallel to each other with a predetermined distance inside the case 2. Also, the spiral contactor 7 provided in the movable electrode 6 faces the spiral contactor 17 provided in the second movable electrode 16 at a position below the operation part 3B.

As shown in FIG. 3, when the pressing force F is applied to the key top 4, the operation part 3B of the actuator 3 extends the spiral contactor 7 of the upper second movable electrode 6 and the operation part 3B extends the spiral contactor 7 of the lower second movable electrode 16. As a result, the movable electrode 6 contacts the second movable electrode 16 firmly. Also, since the operation part 3B presses both the movable electrode 6 and the second movable electrode 16, their functionality as an elastic deformation part can be improved. In other words, as compared with the first embodiment, the operation tactility when the key top is pushed can be varied, thereby improving the operational performance.

Figure 4:
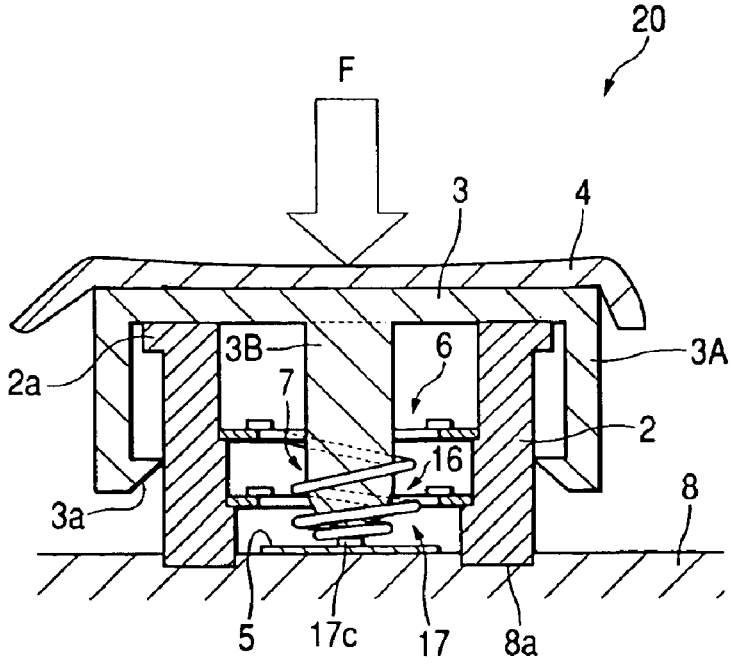
FIG. 4 is a sectional view illustrating a state of a switch device during operation, which is similar to that in FIG. 3, according to a third embodiment of the present invention.

FIG. 4 is a sectional view illustrating a state of the switch device during operation, which is similar to that in FIG. 3, according to a third embodiment of the present invention.

The structure of a switch device 20 according to a third embodiment of the present invention is different from that of the switch device 10 according to the second embodiment of the present invention in that a stationary electrode 5 as a counter electrode is also provided on the surface of the board 8 inside the case 2 in addition to the second movable electrode 16 provided as a counter electrode. The other structure is the same.

In the switch device 20 shown FIG. 4, when the operation part 3B of the actuator 3 is pushed down by applying the pressing force F to the key top 4, the operation part 3B extends the spiral contactor 7 of the upper movable electrode 6 downward, the spiral contactor 7 is brought into contact with the spiral contactor 17 of the lower second movable electrode 16. At this time, the upper movable electrode 6 is brought in electrical connection with the lower second movable electrode 16.

Moreover, when a large pressing force F is applied to the key top 4, the lower spiral contactor 17 is also extended and the winding terminal end (sliding contact point 17*c*) of the spiral contactor 17 is brought in contact with the stationary electrode 5. In this sate, the movable electrode 6, the second movable electrode 16, and the stationary electrode 5 all are brought in electrical connection with each other.

In other words, in the third embodiment, by changing the push-in amount of the operation part 3B by changing the magnitude of a pressing force F, it is possible to select an electrode and/or electrodes to contact the upper movable electrode 6, specifically, only the second movable electrode 16 or both the second movable electrode 16 and the stationary electrode 5. Thus, it is possible to form a switch circuit in which an external circuit to be connected is switched in accordance with the magnitude of the pressing force F.

Also, in the second embodiment, two-layered structure is employed in which the second movable electrode 16 is formed as a counter electrode below the movable electrode 6. However, by stacking a plurality of movable electrodes in their stacked direction, the operation tactility of a switch device can be changed, thereby obtaining excellent operability.

Also, in the third embodiment of the present invention, by stacking a plurality of movable electrodes in their stacked direction, a switch circuit having a plurality of switching functions can be constructed.

As described above, in the present invention, a switch device that prevents a contact failure between contact points from occurring can be provided.

Also, it is possible to provide a switch device having a plurality of switching functions by stacking a plurality of stages of movable electrodes.

What is claimed is:

1. A switch device having a movable electrode, a counter electrode provided to face the movable electrode, and an operating member that pushes at least the movable electrode to bring the movable electrode into contact with the counter electrode, wherein the movable electrode comprises an elastic deformation part that is extensibly deformed in a direction approaching the counter electrode and a sliding contact point that slides along the surface of the counter electrode when contacting the counter electrode, wherein the movable electrode is formed as a spiral contactor spirally formed from its winding start end on the outer circumference side towards its winding terminal end on the center side, and the winding terminal end is formed as the sliding contact point, and wherein the spiral contactor is supported in a cantilever manner.

2. The switch device according to claim 1, wherein the counter electrode is formed as a movable electrode comprising the elastic deformation part and the sliding contact point.

3. The switch device according to claim 1, wherein the spiral contactor includes a plurality of turns.

4. The switch device according to claim 1, wherein a plurality of stages of electrodes having the elastic deformation part and the sliding contact point are stacked with a predetermined distance in the stacked direction at a position facing the movable electrode, and the movable electrode contacts respective counter electrodes that face the movable electrode in accordance with the push-in amount of the operating member in the stacked direction.

* * * * *